United States Patent [19]

Grifhorst

[11] 4,190,250

[45] Feb. 26, 1980

[54] GAME APPARATUS

[76] Inventor: Norman J. Grifhorst, 131 N. Hillside, Wichita, Kans. 67214

[21] Appl. No.: 906,100

[22] Filed: May 15, 1978

[51] Int. Cl.[2] ..... A63B 71/04; A63F 9/00

[52] U.S. Cl. ..... 273/342; 273/124 R; 273/397; 273/402

[58] Field of Search ..... 273/123 R, 124 R, 125 R, 273/95 R, 118 R, 121 R, 122 R

[56] References Cited

U.S. PATENT DOCUMENTS

| | | | |
|---|---|---|---|
| 443,889 | 12/1890 | Armstrong | 273/123 R X |
| 1,195,173 | 8/1916 | Beamer et al. | 273/118 R |
| 1,269,323 | 6/1918 | Shattuck | 273/123 R |
| 1,395,634 | 11/1921 | Fegteborg | 273/124 R |
| 1,474,089 | 11/1923 | Roberts | 273/123 R |
| 1,890,770 | 12/1932 | Coplen et al. | 273/95 R |
| 1,921,186 | 8/1933 | Henderson | 273/125 R |
| 3,424,463 | 1/1969 | Matthews | 273/125 R X |

*Primary Examiner*—George J. Marlo
*Attorney, Agent, or Firm*—Edwin H. Crabtree

[57] ABSTRACT

A game apparatus for the enjoyment of both young and old alike. The game is played on a sloping table wherein a ball is bounced off a launch board at one end of the table on to a portion of carpet for reducing the velocity of the ball. If the ball is accurately thrown, the ball bounces off the carpet and contacts a plurality of rectangular shaped tilted bumpers which carom the rolling ball down a row of staggered bumpers forming a scoring lane on one side of the table and against a score hole bumper and into a score hole. If the ball is inaccurately thrown, the ball rolls down the table and into a return hole.

5 Claims, 4 Drawing Figures

GAME APPARATUS

BACKGROUND OF THE INVENTION

This invention relates generally to a table game and more particularly, but not by way of limitation, to a game using a rolling ball wherein the ball is thrown onto a launch board where it bounces onto the table contacting bumpers which guide the rolling ball into a score hole.

Heretofore, there have been various types of table games using a rolling ball and pinball type machines. None of the prior art games are similar to the novel structure of the subject game apparatus as described herein.

SUMMARY OF THE INVENTION

The subject invention may be played both indoors and outdoors by players of all ages. The game can be quickly learned, and with practice a player develops a skill of accurately throwing a rubber ball off a launch board at one end of a sloping table wherein the ball is caromed off of bumpers into a score hole.

The game apparatus is simple in design, rugged in structure, and is virtually maintenance free since it has no moving parts.

The invention is designed with tilted bumpers so that when the rolling ball contacts the bumpers it is deflected downwardly toward the table top and the ball is kept from bouncing off the top of the table.

The game apparatus includes a game table mounted on legs and having a first side portion, a second side portion, a front portion and a rear portion. The table is sloped downwardly from the front portion to the rear portion. A flat launch board is mounted on top of the rear portion of the table for receiving the ball when it is thrown by the player. A first sideboard extends along the length of the first side portion of the table. A second sideboard extends along the length of the second side portion of the table. A front board extends along the length of the front portion of the table. A first sideboard bumper is attached to the table and adjacent and parallel to the first sideboard. A front board bumper is attached to the table and adjacent to and parallel the front board. A plurality of second sideboard bumpers are attached to the table and are adjacent and parallel the second sideboard. The plurality of second sideboard bumpers are disposed in a staggered spaced relationship to each other forming a scoring lane for guiding the ball into a score hole in the second side portion of the table. If the ball is inaccurately thrown, and it does not properly carom off of the bumpers on the table, the ball rolls down the table and is returned into a return hole.

The advantages and objects of the invention will become evident in the following detailed description when read in conjunction with the accompanying drawings which illustrate the preferred embodiments of the invention.

DETAILED DESCRIPTION OF THE DRAWINGS

Figure 1:
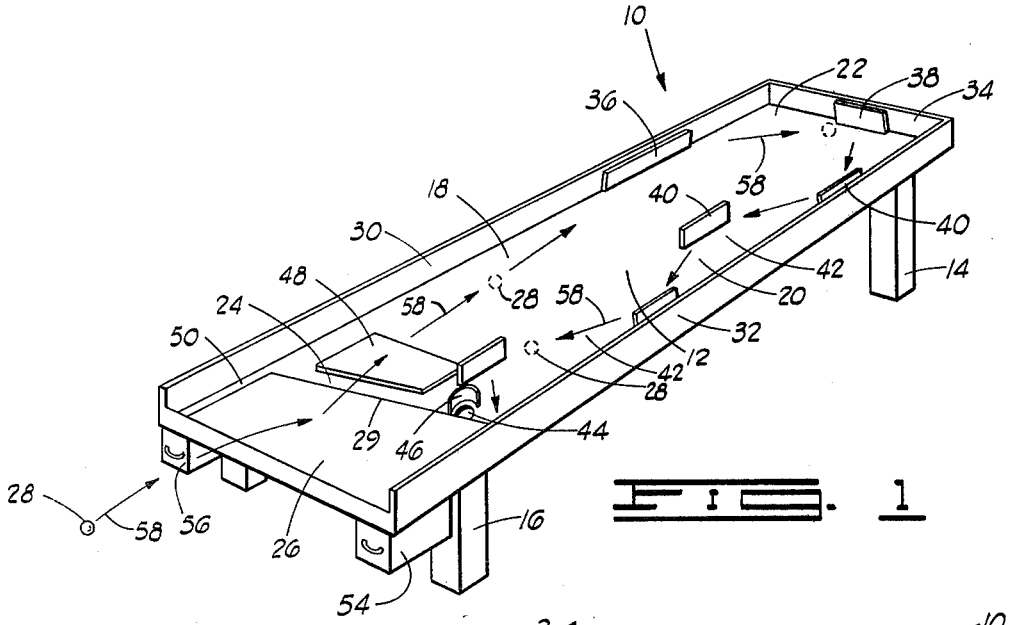
In FIG. 1, a perspective view of the game apparatus.

In FIG. 1 the game apparatus is designated by general reference numeral 10. The apparatus 10 includes a game table 12 mounted on a pair of front legs 14 and rear legs 16. The front legs 14 are longer than the rear legs 16 so that the game table 12 slopes downwardly from front to rear. The table 12 further includes a first side portion 18, a second side portion 20, a front portion 22 and a rear portion 24.

A flat launch board 26 is mounted on top of the rear portion 24 of the table 12 and provides an area for bouncing a rolling ball 28 therefrom at the start of the game. The board 26 further includes an angled front wall 29.

A first sideboard 30 is attached along the length of the first side portion 18 of the table 12. A second sideboard 32 is attached along the length of the second side portion 20 of the table 12. A front board 34 extends along the length of the front portion 22 of the table 12 and is attached thereto.

A first sideboard bumper 36 is attached to the table 12 and is adjacent to and parallel the first sideboard 30. A front board bumper 38 is attached to the table 12 and is adjacent to and parallel the front board 34. A plurality of second sideboard bumpers 40 are attached to the table 12 and adjacent to and parallel the second sideboard 30. The second sideboard bumpers 40 are disposed in a staggered spaced relationship to each other. The second sideboard bumpers 40 extend along the length of the second side portion 20 and form a scoring lane 42 which extends along the length of the second side portion 20 and between the bumpers 40. At the end of the scoring lane 42, is a score hole 44 having a semicircular score hole bumper 46 for guiding the ball 28 into the hole 44.

Also attached to the top of the table 12 and adjacent the launch board 26 is a section of carpet 48 or the like. The carpet contacts the ball 28 after it bounces off the launch board 26 and provides a surface area for reducing the velocity of the ball as it heads upwardly toward the front portion 22 of the table 12.

Should the player fail to accurately carom the ball 28 off the bumpers 36, 38 and 40 and into the score hole 44, the ball 28 rolls downwardly toward the rear portion 24 of the table 12 and contacts the angled front wall 29 of the board 26 which guides the ball 28 into a return slot 50 disposed between a portion of the first sideboard 30 and a portion of the launch board 26. The slot 50 guides the ball 28 into a return hole 52 shown in FIG. 2. The score hole 44 communicates with a score box 54 which collects the balls that are received from the score hole 44. A return box 56 is communicably connected to the return hole 52 for collecting the balls that fail to score.

Figure 2:
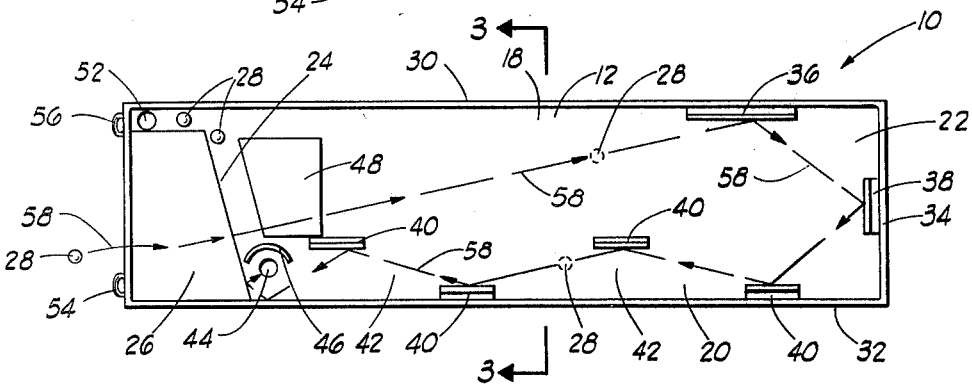
FIG. 2 is a top view of the game apparatus.

In FIG. 2 a top view of the game apparatus 10 is illustrated. In this view, the path of the ball 28 can be seen as indicated by arrows 58 contacting the bumper 36, the bumper 38 and bumpers 40, prior to dropping into the score hole 44.

In operation, the game is played by standing next to the rear portion 24 of the table 12 and bouncing the ball 28 off of the launch area 26. If the ball 28 is accurately thrown, it will contact the carpet 48 wherein its velocity is reduced so that the speed of the ball 28 has been slowed down sufficiently so that when it contacts the bumpers, the ball 28 does not tend to ricochet off of the playing surface of the table 12. Again, if the ball 28 is accurately thrown, it will head upwardly toward the first sideboard bumper 36 where it caroms off of and toward the front board bumper 38. The ball 28 then caroms off of the bumper 38 and enters the scoring lane 42 where it continues to carom off the staggered second sideboard bumpers 40 until the ball 28 contacts a portion of the front wall 29 of the launch board 26 or the second sideboard 32 and is guided into the score hole 44 by the score hole bumper 46. Should the ball 28 fail to enter the scoring lane 42 or leave the score lane 42 as it caroms off the bumpers 40, it will roll downwardly into the rear portion 24 of the table 12 where it is guided into the return slot 50 by the front wall 29 or by the first sideboard 30. The ball 28 then drops into the return hole 52 and into the return box 56. The game apparatus 10, for example, could be played with two players each having 10 balls apiece. The players could throw their balls alternately, or a player could throw his balls one at a time with his opponent following after the 10 balls are thrown. At the end of the game the player that has the most balls in the score box 54 would be the winner. The balls could also be colored to distinguish one player's balls from another.

Figure 3:
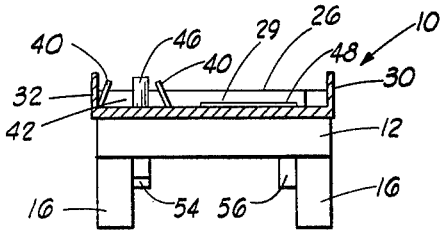
FIG. 3 is an end sectional view of the game apparatus taken along lines 3—3 shown in FIG. 2.

In FIG. 3 an end sectional view taken along lines 3—3 in FIG. 2 are shown. This view is to illustrate that the bumpers 36, 38 and 40 are rectangular in shape and tilted inwardly from the vertical so that when the ball 28 hits the bumpers it will be deflected downwardly toward the top of the table 12 so that the ball 28 as it rolls on the table 12 will tend to stay on the playing surface of the table 12 rather than bounce upwardly and off the table 12. Along the scoring lane 42, the bumpers 40 are tilted toward each other for guiding the ball 28 toward the scoring hole 44.

Figure 4:
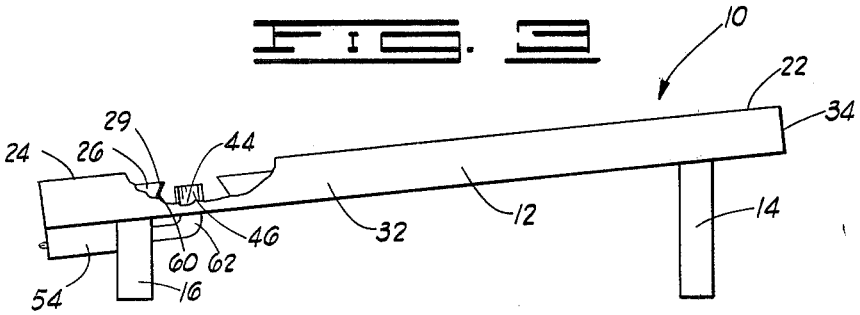
FIG. 4 is a side view of the game apparatus.

In FIG. 4 a side view of the table 12 is illustrated. In this view the table 12 can be seen sloped downwardly from the front portion 22 toward the rear portion 24. Also, a portion of the second sideboard 32 is cutaway to illustrate an inwardly inclined surface 60 of the front wall 29 of the board 26. The inclined surface 60 again prevents the ball 28 from deflecting upwardly and off the table 12. Aslo shown is a collection tube 62 communicably connecting the score hole 44 with the score box 54 for returning the ball 28 to the score box 54.

Changes may be made in the construction and arrangement of the parts or elements of the embodiments as described herein without departing from the spirit or scope of the invention defined in the following claims.

I claim:

1. A game apparatus for receiving a rubber rolling ball thereon, the apparatus comprising:

a game table mounted on legs and having a first side portion, a second side portion, a front portion, and a rear portion, said table sloped downwardly from the front portion to the rear portion of said table;

a flat launch board mounted on top of the rear portion of said table for bouncing the ball onto the table, said launch board having an angled front wall for receiving the rolling ball when the ball rolls downwardly from the top portion to the rear portion of said table;

a first side board extending along the length of the first side portion of said table and attached thereto;

a second sideboard extending along the length of the second side portion of said table and attached thereto;

a front board extending along the length of the front portion of said table and attached thereto;

a first rectangular-shaped sideboard bumper attached to said table and adjacent to and parallel said first sideboard, said first sideboard bumper tilted inwardly toward the center of said table;

a rectangular-shaped front board bumper attached to said table and adjacent to and parallel said front board, said front board bumper tilted inwardly toward the center of said table;

a plurality of rectangular-shaped second sideboard bumpers attached to said table and adjacent to and parallel said second sideboard, said second sideboard bumpers disposed in a staggered spaced relationship to each other and extending along the length of the second side portion of said table, said second sideboard bumpers forming a scoring lane therebetween, said second sideboard bumpers tilted inwardly toward each other;

a score hole in the second side portion of said table and adjacent the front wall of said launch board;

a score hole bumper attached to said table and disposed around a portion of said score hole for guiding the ball into said score hole;

a return hole in the first side portion of said table and adjacent said launch board, the angled front wall of said launch board guiding the ball downwardly to said return hole; and a portion of carpet, disposed in front of said launch board and attached to said table, said carpet acting to reduce the velocity of the ball when the ball is bounced off of said launch board and onto said table.

2. A game apparatus for receiving a rubber rolling ball thereon, the apparatus comprising:

a game table mounted on legs and having a first side portion, a second side portion, a front portion and a rear portion, said table sloped downwardly from the front portion to the rear portion of said table;

a flat launch board mounted on top of the rear portion of said table for bouncing the ball onto said table, said launch board having an angled front wall for receiving the rolling ball when the ball rolls downwardly from the top portion to the rear portion of said table;

a portion of carpet, the carpet being disposed in front of said launch board and attached to said table, said carpet acting to reduce the velocity of the ball when the ball is bounced off said launch board and onto said table;

a first sideboard extending along the length of the first side portion of said table and attached thereto;

a second sideboard extending along the length of the second side portion of said table and attached thereto;

a front board extending along the length of the front portion of said table and attached thereto;

a first sideboard bumper attached to said table and adjacent to and parallel said first sideboard;

a front board bumper attached to said table and adjacent to and parallel said front board;

a plurality of second sideboard bumpers attached to said table and adjacent to and parallel said second sideboard, said second sideboard bumpers disposed in a staggered spaced relationship to each other and extending along the length of the second side portion of said table, said second sideboard bumpers forming a scoring lane therebetween;

a score hole in the second side portion of said table and adjacent said launch board; and a return hole in the first side portion of said table and adjacent said launch board.

3. The game apparatus as described in claim 1 further including a score hole bumper attached to said table disposed around a portion of said score hole for guiding the ball into said score hole.

4. The game apparatus as described in claim 1 wherein said bumpers are rectangular in shape and tilted at an angle from a vertical position so that the ball when contacting said bumpers is prevented from bouncing upwardly and off said game table.

5. The game apparatus as described in claim 2 further including a score box mounted on the bottom of said game table and communicating with said score hole for receiving the rolling ball therefrom and a return box mounted on the bottom of said game table and communicating with said return hole for receiving the rolling ball therefrom.

* * * * *